United States Patent [19]

Bruderer et al.

[11] 3,946,795

[45] Mar. 30, 1976

[54] METHOD AND APPARATUS FOR REGULATING THE MOLTEN METAL LEVEL IN A MOLD OF A CONTINUOUS CASTING INSTALLATION

[75] Inventors: Werner Bruderer, Feldmeilen, Switzerland; Hans Thiemann, Dusseldorf, Germany

[73] Assignees: Schloemann Aktiengesellschaft, Dusseldorf, Germany; Concast AG, Zurich, Switzerland

[22] Filed: Oct. 12, 1973

[21] Appl. No.: 405,761

[30] Foreign Application Priority Data

Oct. 17, 1972 Switzerland ..... 15186/72

[52] U.S. Cl. ..... 164/154; 164/281

[51] Int. Cl.[2] ..... B22C 19/04; B22D 11/16

[58] Field of Search ..... 164/4, 82, 154, 281, 282

[56] References Cited

UNITED STATES PATENTS

| | | | |
|---|---|---|---|
| 2,709,284 | 5/1955 | Evans et al. | 164/4 |
| 3,300,820 | 1/1967 | Tiskus et al. | 164/155 |
| 3,478,808 | 11/1969 | Adams | 164/4 |
| 3,521,696 | 7/1970 | Lowman et al. | 164/154 |
| 3,605,862 | 9/1971 | Schultz | 164/155 |
| 3,627,021 | 12/1971 | Schultz et al. | 164/281 X |

FOREIGN PATENTS OR APPLICATIONS

| | | | |
|---|---|---|---|
| 45-8407 | 3/1970 | Japan | 164/154 |

*Primary Examiner*—Francis S. Husar
*Assistant Examiner*—John S. Brown
*Attorney, Agent, or Firm*—Werner W. Kleeman

[57] ABSTRACT

A method of and apparatus for regulating the molten metal level in the mold of a continuous casting installation wherein deviations from a reference value determined by measuring the molten metal level in the continuous casting mold are overcome by regulating the infeed of metal to the mold and/or by regulating the withdrawal speed of the strand from the mold. The invention contemplates simultaneously delivering the adjustment values or magnitudes generated at the metal infeed regulation circuit to the strand withdrawal regulation circuit and changing the predetermined or preset reference value of the withdrawal regulation as a function of such adjustment values in accordance with a predetermined or preset function and this function is prescribed or preset such that the reference value of the withdrawal regulation is only then influenced when the change in the adjustment value in the infeed regulation circuit per unit of time exceeds a predetermined or preset value.

5 Claims, 2 Drawing Figures

METHOD AND APPARATUS FOR REGULATING THE MOLTEN METAL LEVEL IN A MOLD OF A CONTINUOUS CASTING INSTALLATION

BACKGROUND OF THE INVENTION

The present invention relates to a new and improved method of regulating the level of the molten metal in the molds of continuous casting plants or installations, wherein deviations from a reference value as determined by measuring the level of the molten metal in the mold are overcome by regulating the metal infeed to the mold and/or by regulating the withdrawal speed of the strand from the mold.

It is known during continuous casting of metals to employ a molten metal level regulation or control wherein initially by carrying out an infeed regulation, for instance by means of a stopper, the degree of filling or molten metal level in the mold is regulated in accordance with a prescribed or preset reference value. If the degree of filling of the mold exceeds predetermined or preset boundaries of such reference value, then there is switched over from the metal infeed regulation to a regulation of the withdrawal speed i.e. the casting speed of the strand. During regulation of the withdrawal speed the sets of drive rolls conveying the continuously cast strand are controlled such that by slowing down or accelerating the withdrawal speed of the strand there is maintained the required level of the molten metal in the mold. The withdrawal regulation first then becomes operational when the deviation of the level of the molten metal in the mold from the reference value has exceeded a predetermined upper or lower boundary value.

Such type regulation with switching-over or reversal from the metal infeed regulation circuit to the strand withdrawal regulation circuit and vice versa possesses the drawback that at the moment of switching-over from the regulation of the stopper to the regulation of the withdrawal of the casting or strand, the control or regulator for the withdrawal speed has delivered thereto the maximum deviation signal of the level of the molten bath, because the withdrawal regulation has not followed the actual value of the molten bath level. Hence, related to the reference value, there initially occurs a sudden drop or rise in the level of the molten metal in the mold. During sudden rise of the level of the molten metal there however occurs an immediate switching back to regulation of the stopper, so that initially it is not possible to prevent an unrest or surging of the regulation. This occurs in that each time there is reached the switch-over value from the metal infeed regulation to the strand withdrawal control the regulation again switches back to regulation of the stopper, again resulting in a drop or rise in the molten bath level. Hence, upon reaching the transition conditions from the regulation of the stopper to the regulation of the withdrawal of the strand there arises a frequent switching from the one to the other regulation circuit, producing a so-called surging or hunting of the regulation system. As a result, there prevail unavoidable disturbances, such as overflow of the liquid steel from the upper edge of the mold during operation as well as break-outs in and beneath the mold, requiring increased expenditure in the supervision and maintenance of the continuous casting installation by the operating personnel. However, also at the region of the simultaneous working of the infeed regulation circuit and the withdrawal regulation circuit there hardly can be attained a constant bath level in the mold, since due to the simultaneous action of both circuits each circuit is influenced by the other, generally resulting in an unsuitable regulation. Additionally, the strand withdrawal speed considerably deviates from the desired speed, with the result that the quality as well as the continuous operation, that is the economies of the installation, are considerably impaired.

SUMMARY OF THE INVENTION

Hence, from what has been explained above, it should be apparent that this particular field of technology is still in need of methods of, and apparatus for, controlling the molten metal level at a continuous casting mold of a continuous casting installation in a manner not associated with the aforementioned drawbacks and limitations of the prior art proposals. Thus, it is a primary object of the present invention to provide an improved method of, and apparatus for, controlling the level of the molten metal in a mold of a continuous casting installation in a manner which effectively and reliably fulfills the existing needs in the art and is not associated with the aforementioned drawbacks and limitations of the prior art proposals.

Another object of the present invention relates to the provision of an improved method of, and apparatus for, regulating the molten metal level in a mold in a manner rendering it possible to exactly regulate and maintain the degree of filling or level of the metal bath in the mold by means of the infeed of metal to the mold as well as the withdrawal speed of the formed strand from the mold.

A further object of this invention relates to an improved method of, and apparatus for, regulating the level of the molten metal in a continuous casting mold in a manner rendering it possible to control the level of the molten metal in the mold by means of the infeed of such molten metal into the mold as well as the withdrawal speed of the casting from the mold without there being present the drawbacks of overflow of steel from the mold, frequent break-outs in and beneath the mold and increased personnel requirements.

Now in order to implement there and still further objects of the invention, which will become more readily apparent as the description proceeds, the method aspects of this development contemplate that the adjustment magnitudes generated at the metal infeed regulation circuit are simultaneously delivered to the strand withdrawal regulation circuit and the prescribed or preset reference value of the strand withdrawal regulation is changed as a function of such adjustment magnitudes according to a prescribed or preset function and this function preset or is predetermined such that the reference value only then influences the withdrawal regulation when the change in the adjustment magnitude in the infeed regulation circuit per unit of time exceeds a predetermined value.

Due to the simultaneous infeed of the adjustment magnitudes generated at the metal infeed regulation circuit to the strand withdrawal regulation circuit there is possible the simultaneous regulation or action of both regulation circuits. The change of the reference value of the withdrawal regulation according to a predetermined or preset function which is dependent upon the deviations of the adjustment magnitudes at the infeed regulation circuit which are generated by deviations of the molten metal level, prevents the undesired reversing or switching-over from one regulation circuit to the other, that is to say, the so-called hunting or fluttering, prevents the overflow of the mold and reduces the number of break-outs in and beneath the mold. By means of such technique it is possible to exactly maintain the degree of filling of the mold at the desired level, whereby the prescribed or preset function in the withdrawal regulation circuit permits maintaining the withdrawal speed constant for the normal case, something which is generally desired in practice. If the quantity of melt flowing into the mold markedly changes during a given period of time, which with the prior art regulators only first then will be recognized upon reaching the boundary value, then the bath level regulation of this invention begins to immediately carry out its cooperative regulating function by uniformly changing the withdrawal speed. The strand withdrawal regulation which is dependent upon such function prevents sudden and uncontrollable changes in the bath level owing to changes in the infed quantity of melt and the sudden changes of the strand withdrawal speed resulting therefrom with the prior art regulation systems.

During slow clogging of the outflow nozzle of the tundish, that is, slow decrease of the quantity of metal fed into the mold, the method aspects of the invention can be advantageously further supplemented in that upon reaching a certain upper and lower boundary value of the molten metal level in the mold, independent of the change in the adjustment magnitude at the inflow control circuit per unit of time, the adjustment magnitude can be influenced at the withdrawal control circuit. If the reference value of the withdrawal control is likewise influenced independently of the change of the adjustment magnitude per unit of time upon reaching certain upper and lower boundary values, then the method can be carried out more positively and fewer additional operating personnel are required in that there is prevented a slow increase in the level of the bath and the thus resulting overflow of the mold or a slow decrease with subsequent break-out beneath the mold.

A further advantageous solution is realized in that after a change in the adjustment magnitudes at the withdrawal regulation circuit, i.e., also the withdrawal speed, the withdrawal speed is again restored to the original reference value. This return to the original value of the adjustment magnitude after a change in the withdrawal speed owing to a change of the bath level, which brings about the response of the infeed regulation circuit as well as the withdrawal regulation circuit, renders possible withdrawing the strand for such length of time at the most favorable speed until the bath level in the mold is no longer influenced by the regulation of the infeed of metal. After a change of the withdrawal speed owing to a change of the adjustment magnitude at the inflow or infeed regulation circuit which change exceeds a certain value per unit of time, the withdrawal speed is reset with a certain speed to the original value. This restoring or return speed is calculated such that the change in the level of the molten metal and the thus resulting change in the adjustment magnitude at the inflow regulation circuit does not reach the boundary value for response of the withdrawal regulation circuit. If the infeed regulation circuit, for instance due to reaching the boundaries of the regulation range, no longer is capable of influencing the bath level, the resetting or restoring is discontinued and deviates from the most favorable casting speed.

Not only is the invention concerned with the aforementioned method aspects, but as indicated above is also concerned with an improved apparatus for carrying out the aforementioned method which is manifested by the features that the measuring device, the reference value adjustment means, the comparators and the regulator for the molten metal level are common to both regulating circuits and both circuits are connected in parallel with one another. Further, an additional function transmitter or generator having a reference value adjustment means is connected with the withdrawal regulation circuit.

By means of the measurement device there is determined the level of the molten metal of the continuous casting mold, such is delivered to the comparator and regulator, as a result of which there is produced the adjustment magnitude for influencing the adjustment element of the inflow regulation mechanism. This adjustment magnitude is simultaneously delivered to a function transmitter or generator of the withdrawal regulation circuit, this function transmitter determining whether the reference value generated by the reference value adjustment or determining means for the withdrawal control circuit influences the withdrawal speed. Owing to this arrangement there is ensured for reliable operation of the molten bath level regulation and hunting is completely prevented upon obtaining the transition conditions from regulation of the stopper strand withdrawal regulation. At the same time there can be obtained with less personnel a more economical and positive operation of the continuous casting installation.

BRIEF DESCRIPTION OF THE DRAWING

The invention will be better understood and objects other than those set forth above, will become apparent when consideration is given to the following detailed description thereof. Such description makes reference to the annexed drawing wherein.

DETAILED DESCRIPTION OF THE PREFERRED EMBODIMENTS

Figure 1:
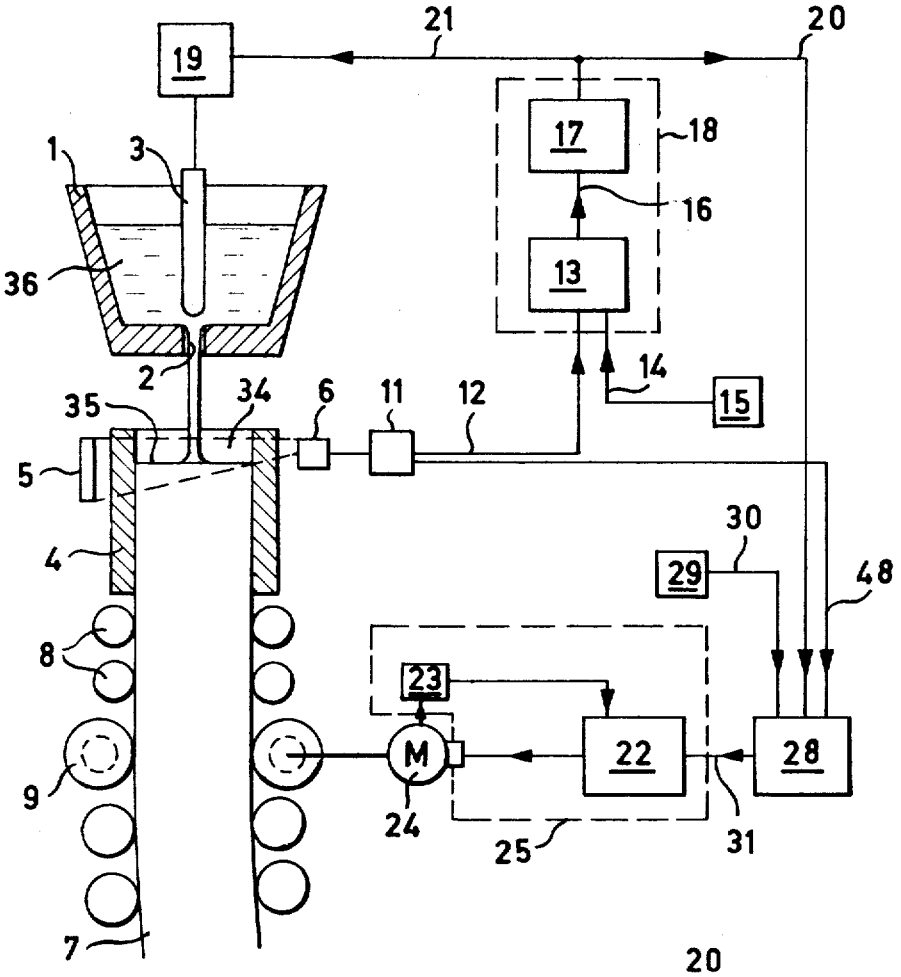
FIG. 1 is a schematic illustration of a continuous casting installation and the principal block circuit diagram of the bath level regulation.

Referring now to the drawing, it is to be understood that only enough of the construction of the continuous casting installation or machine has been depicted herein to enable those skilled in the art to readily understand the underlying concepts of this development. Hence, the exemplary embodiment of continuous casting machine or installation as depicted in FIG. 1 will be understood to comprise a tundish 1 with an outflow or discharge opening 2 which can be closed by a stopper or stopper rod 3. Beneath the tundish 1 there is located the continuous casting mold 4, after which are arranged guide elements for instance in the form of rollers or rolls 8. Further downstream of the system there are arranged drive rolls or rollers 9 which withdraw the casting or strand 7 which is formed at the mold 4 out of the latter. During the casting operation liquid metal is cast from a non-illustrated ladle into the tundish 1. Initially, the stopper or stopper rod 3 remains closed until the molten metal at the tundish 1 has reached a certain level or fill height. At this moment the outflow opening or nozzle 2 is manually or automatically opened by raising the stopper rod 3. Liquid melt or metal then flows through the outlet opening or nozzle 2 into the hollow compartment 34 of the mold 4, the lower end of which is closed in the usual way by a non-illustrated stopping and withdrawing head connected with a dummy bar. If the molten metal level 35 at the mold 4 reaches a lower boundary value, then the drive rolls 9 being to withdraw the stopping and withdrawing head and the solidifying casting out of the mold 4. Determination of the molten metal level takes place by means of a radioactive emitter 5 and associated receiver 6 as is known in this art. The withdrawal speed of the drive rolls 9 is increased according to a prescribed or preset function which is not further discussed at this point, until reaching a certain reference value of the molten metal level 35 at the mold 4. Only when this reference value has been reached does the inventive molten metal level regulation or control of this development begin to function. Switching-in of the molten metal level regulation can be carried out automatically or through the agency of a non-illustrated control switch.

The receiver 6 records all deviations in both the positive as well as the negative direction of the molten metal level 35 of the bath, and transforms such at the measurement device 11 into suitable measurement signals. These measurement signals are delivered via a connection line 12 to a comparator 13. Comparator 13 is connected through the agency of a connection line 14 with a reference value-adjustment means 15 for the level of the molten metal bath at the continuous casting mold 4. Deviations in the bath level determined by the comparator 13 are delivered via a connection line 16 to a transmission element 17. Transmission element 17 determines the adjustment or settling value for the metal inflow control or regulation, that is to say, in this case, for the displacement of the stopper rod 3 upwards or downwards. Serving as the adjustment of the stopper rod 3 is an adjustment element 19 which is coupled via a connection line 21 with regulator or control 18. The adjustment magnitudes determined by the regulator 18 for the stopper rod 3 are simultaneously delivered via a connection line 20 to a function transmitter or generator 28. This function transmitter 28 is coupled through the agency of a connection line 30 with a reference value-adjustment means 29 for the withdrawal speed of the casting 7 during normal casting operation. The values determined by the function transmitter 28 are delivered through the agency of a connection line 31 to a rotational speed regulator 25 for the drive rolls 9. This rotational speed regulator 25 is mounted at a drive motor 24 for the drive rolls 9 and consists of a block 22 which incorporates a comparator, transmission element and adjustment element as well as a tachogenerator 23.

If, during a casting operation the molten metal level 35 deviates, for instance upwards from its reference value, then, this deviation is determined by the comparator 13 and delivered to the transmission element 17. At the transmission element 17 there is selected an adjustment value in accordance with the regulation or control function and the bath level deviation, this adjustment value placing into operation the adjustment element 19. Adjustment element 19 now moves the stopper or stopper rod 3 downwardly to such extent until only that quantity of liquid metal now flows out of the nozzle opening 2 which prevents further rise of the molten metal bath level 35 and permits such bath level to again go back to the desired reference value. The adjustment value, which is delivered via the line 21 to the adjustment element 19, is simultaneously delivered via the function transmitter 28 also to the strand withdrawal regulation or control circuit.

Figure 2:
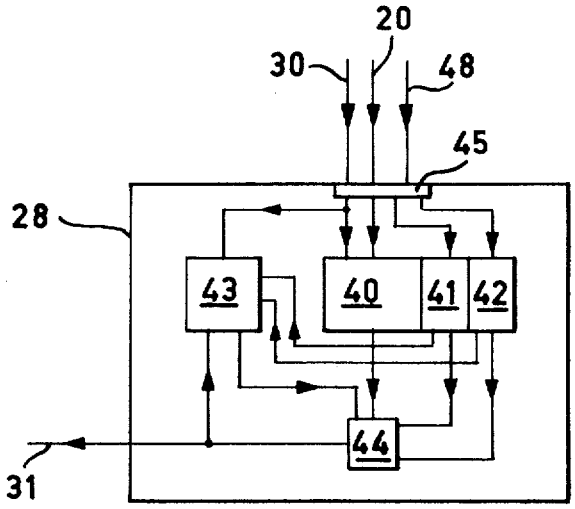
FIG. 2 is a block circuit diagram of the function transmitter or generator of the strand withdrawal regulation circuit.

The function generator or transmitter 28 has been shown in block circuit diagram in FIG. 2. The individual components of such function transmitter are standard commercially available components as the same are employed in conventional regulation devices and process controls. An input signal distributor 45 is provided with inputs for the connection lines 20, 30 and 48. The signals of the connection line 20 are delivered to a signal processing unit 40 and the signals of the line 30 are delivered to the unit 40 as well as a feedback or return unit 43. The signal processing units 41 and 42 receive their signals via the connection line 48 directly from the measuring or measurement device 11. All units 40, 41, 42 and 43 deliver their output signals to output stage 44 which is coupled via the line 31 with the rotational speed regulator 25. The signal for the rotational speed regulator 25 is simultaneously also delivered to the feedback unit 43. The change of the prescribed or preset reference value of the strand withdrawal regulation in the function transmitter 28 is undertaken according to a prescribed or preset function such that this function transmitter 28 only then permits influencing the casting withdrawal speed by the adjustment value delivered by the regulator 18 when the change of such adjustment magnitude or value at the inflow control circuit per unit of time exceeds a predetermined value, that is to say, during a slight and slow change of the molten metal bath level 35 towards the bottom or the top, the withdrawal regulation circuit initially should not respond to such deviation. If the bath level 35 however suddenly increases owing to a breakout of the nozzle or discharge opening 2, then this increase cannot be controlled alone by the stopper regulation circuit within the time available until overflow of the mold. This rapid increase in the level of the bath of molten metal is, however, also determined by the function generator or transmitter 28 by means of the signal processing unit 40 and owing to the change in the adjustment magnitude at the inflow regulation circuit which exceeds a certain value per unit of time, the reference value emanating from the reference value adjustment means 29 is changed which, in turn, brings about via the rotational speed regulator 25 an increase in the withdrawal speed.

With a slow rise or fall of the molten metal bath level 35, the reference value of this bath level is initially only regulated by means of the inflow regulation circuit. During casting of certain qualities of steels, it can be observed that constituents of the cast material are separated at the discharge or nozzle opening 2 and deposit at the walls thereof. As a result, the nozzle opening 2 always becomes smaller, resulting in the phenomenon that less steel also flows out thereof, that is to say, the bath level 35 drops slowly. This dropping of the bath level is now initially corrected in that the stopper or stopper rod 3 is moved upwards. The stopper rod 3 can be, however, only moved upwards through a certain amount or, in other words, influencing the discharge or nozzle opening 2 is only possible for such length of time until the nozzle opening is completely freed or the stopper rod 3 bears against its upper impact or stop. Now if further material deposits at the wall of the nozzle opening 2, then less and less material will flow out of such nozzle opening and the bath level 35 will further slowly drop. Since this decrease in the bath level only occurs slowly and the change of the adjustment magnitude at the inflow control circuit does not exceed a certain value per unit of time, the reference value of the withdrawal control circuit is not changed. In this case it is particularly advantageous if upon reaching certain upper and lower boundary values the degree of filling or molten metal level 35 is influenced independent of the change of the adjustment magnitude per unit of time of the reference value of the withdrawal regulation circuit by the prescribed or preset function. As soon as the molten bath level 35 for the mentioned example has dropped to the predetermined lower boundary value, a signal is delivered by the measurement device 11 which causes the signal processing unit 41 at the function transmitter 28 to change the reference value emanating from the reference value transmitter 29 via the output stage 44, and specifically for such length of time until the bath level 35 has again reached its prescribed reference value. The same procedures in the reverse direction can arise if the nozzle or discharge opening 2 becomes larger owing to flushing out. In this case the increase of the material per unit of time which departs from the nozzle opening 2 is slight, so that the bath level 35 only rises slowly. If it however reaches the upper boundary value of the bath level 35, then a signal is likewise delivered by the measurement device 11 which causes the signal processing unit 42 at the function transmitter 28 to change the reference value emanating from the reference value transmitter 29 via the output stage 44 until the bath level 35 again has attained its prescribed reference value.

Since the casting speed is generally fixed at as high as possible a value, at which simultaneously there are insured good surface and good casting qualities, it is desirable that the casting speed remain as constant as possible throughout the entire casting operation. In order to guarantee for such, a feedback unit 43 is associated with the function generator or transmitter 28 which after each change of the reference value of the withdrawal speed, strives to again adjust the original reference value. The feedback unit 43 compares the value delivered by the output stage 44 with the reference value of the reference value-adjustment means 29 and in the presence of deviations strives to again maintain the desired reference value with a certain time delay through direct action upon the output stage 44. During control of the bath level 35 with the aid of the metal inflow regulation circuit as well as the strand withdrawal regulation circuit owing to a change of the adjustment magnitude at the inflow regulation circuit which exceeds a certain value per unit of time, the favorable prescribed withdrawal speed for the casting operation is increased or reduced. After the bath level 35 has again reached its prescribed reference value, the feedback unit 43 at the function transmitter 28 insures that the withdrawal speed is changed for such length of time until it again reaches the value most favorable for the casting operation. This change in the withdrawal speed brings about a deviation of the bath level 35 in the positive or negative direction which is then recorded by the measurement device or mechanism 11. These changes are, however, only of such magnitude per unit of time that only the inflow regulation or control circuit responds thereto. As a result, the position of the stopper or stopper rod 3 is changed for such length of time until the bath level 35 again reaches the prescribed or preset reference value and the withdrawal speed of the casting 7 likewise corresponds to the desired casting speed most favorable for the casting operation. If a correction of the bath level 35 is no longer possible by changing the position of the stopper rod 3, then, also in this case the bath level changes until it has reached the predetermined upper or lower boundary value which then insures that the reference value of the withdrawal circuit is changed independently of the change in the adjustment magnitude per unit of time at the inflow control circuit with the aid of the units 41 or 42. In this case in order to prevent that the regulation or control system surges or hunts about one of the boundary values there is generally insured that upon switching-in the withdrawal regulation circuit through one of the boundary values, that is to say with a regulation or control via the units 41 or 42 there is bridged or shunted the feedback unit 43 at the function transmitter 28. Hence, in the case where the inflow regulation circuit no longer can carry out the desired influence upon the reference value of the bath level 35, there is a deviation from the most favorable casting speed, that is to say, casting proceeds with an increased or reduced withdrawal speed. This is however only possible until reaching predetermined upper or lower boundary values of the withdrawal speed. Upon reaching these boundary values an alarm signal is triggered or in fact the entire casting operation is shutdown or interrupted.

While there is shown and described present preferred embodiments of the invention, it is to be distinctly understood that the invention is not linited thereto, but may be otherwise variously embodied and practiced within the scope of the following claims.

What is claimed is:

1. A method of regulating the level of molten metal in a continuous casting mold of a continuous casting installation, wherein deviations in the level of the molten metal in the continuous casting mold, as determined by measuring such level, from a reference value are eliminated by regulating either the inflow of metal to the mold, the withdrawal speed of the strand from the mold, or both the inflow of metal to the mold and the withdrawal speed of the strand from the mold, the improvement comprising the steps of generating a signal indicative of deviations from said reference value, generating adjustment magnitudes at a metal inflow regulation circuit in response to said signal, delivering such adjustment magnitudes to a strand withdrawal regulation circuit, altering a preset reference value of the strand withdrawal regulation in dependency of such adjustment magnitudes according to a preset function, and presetting said function such that the reference value of the strand withdrawal regulation is only then influenced when the change in the adjustment magnitude in the metal inflow regulation circuit per unit of time exceeds a preset value.

2. The method as defined in claim 1, further including the step of influencing the adjustment magnitude at the strand withdrawal regulation circuit independent of the change of the adjustment magnitudes at the metal inflow regulation circuit per unit of time upon attaining certain upper and lower boundary values of the molten metal level.

3. The method as defined in claim 2, including the step of restoring the strand withdrawal speed again to an original reference value after a change of the adjustment magnitude in the strand withdrawal regulation circuit.

4. An apparatus for controlling the molten metal level in a mold of a continuous casting installation, comprising a first regulation circuit for the regulation of the infeed of molten metal to the mold, said first regulation circuit comprising reference value-adjustment means for presetting a reference value of the level of the molten metal in the mold, a comparator in circuit with said reference value-adjustment means, a first transmission element in circuit with said comparator, an adjustment element for adjusting the flow of metal into the mold in circuit with said transmission element, and output means connecting said transmission element with said adjustment element for transmitting adjustment signals thereto, a second regulation circuit for regulating the withdrawal speed of the cast strand from the continuous casting mold, said second regulation circuit incorporating a comparator, a second transmission element in circuit with said comparator, and an adjustment element for adjusting the withdrawal speed of the strand from the mold, measuring means for determining the degree of filling of the mold, both regulation circuits being connected in parallel with said measuring means, a function generator operatively connected with said measuring means and said second regulation circuit, a reference value-adjustment means for presetting a reference value of the withdrawal speed of the strand operatively connected with said function generator, and means for altering the reference value of the withdrawal speed in dependence upon adjustment signals generated by said first transmission element.

5. The apparatus as defined in claim 4, wherein said output means is operatively connected both with said adjustment element for adjusting the flow of metal into the mold and with said function generator.

* * * * *